US009000878B1

(12) United States Patent
Lazzerini et al.

(10) Patent No.: US 9,000,878 B1
(45) Date of Patent: Apr. 7, 2015

(54) MAGNETIC COMPONENT WITH BOBBINLESS WINDING

(75) Inventors: Lorenzo Lazzerini, Terranuova Bracciolini (IT); Giovanni Silvestri, Cecina (IT); Nicola Cinagrossi, Uster (CH)

(73) Assignee: PAI Capital LLC, San Jose, CA (US)

( * ) Notice: Subject to any disclaimer, the term of this patent is extended or adjusted under 35 U.S.C. 154(b) by 1162 days.

(21) Appl. No.: 12/780,498

(22) Filed: May 14, 2010

Related U.S. Application Data

(60) Provisional application No. 61/312,556, filed on Mar. 10, 2010.

(51) Int. Cl.
*H01F 27/28* (2006.01)

(52) U.S. Cl.
CPC ..... *H01F 27/2895* (2013.01)

(58) Field of Classification Search
USPC ..... 336/83, 200, 232, 192, 174–175, 225, 336/229
See application file for complete search history.

(56) References Cited

U.S. PATENT DOCUMENTS

| | | | | |
|---|---|---|---|---|
| 5,331,536 | A * | 7/1994 | Lane | 363/126 |
| 5,621,636 | A * | 4/1997 | Tanigawa et al. | 363/147 |
| 5,684,445 | A * | 11/1997 | Kobayashi et al. | 336/83 |
| 7,982,576 | B2 * | 7/2011 | Feng et al. | 336/232 |
| 8,013,709 | B2 * | 9/2011 | Tsai et al. | 336/208 |
| 8,164,406 | B2 * | 4/2012 | Lin et al. | 336/61 |
| 8,395,470 | B2 * | 3/2013 | Lin | 336/199 |

* cited by examiner

*Primary Examiner* — Tuyen Nguyen
(74) *Attorney, Agent, or Firm* — Patterson Intellectual Property Law P.C.; Mark J. Patterson

(57) ABSTRACT

A transformer having a bobbinless winding assembly positioned on a base includes a primary winding having multiple radially-spiraling turns of a wire and a secondary winding including a substantially planar annular disk having a radial gap defined therein. A primary winding having first and second primary windings including multiple radially-spiraling turns of wire with free ends extending from outer turns and a method of forming the same is provided. A secondary winding having a planar annular disk with a radial gap defined therein and a method of forming the same is also provided.

4 Claims, 14 Drawing Sheets

MAGNETIC COMPONENT WITH BOBBINLESS WINDING

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application which is hereby incorporated by reference: U.S. Provisional Patent Application No. 61/312,556, filed Mar. 10, 2010.

BACKGROUND OF THE INVENTION

The present invention relates generally to a magnetic component including an electrically conductive winding for an electronic circuit. More particularly, the present invention relates to a bobbinless transformer having a coiled primary winding and a secondary winding forming an annular disk.

Magnetic components such as transformers are known in the art. Conventional transformers typically include a primary winding having multiple turns of a conductive wire. In the prior art, the individual turns are typically wound around a bobbin structure. The bobbin structure provides support for the shape of the primary winding. The bobbin structure of conventional transformers often includes a hollow void extending along the longitudinal axis of the bobbin structure, and a magnetically permeable core is positioned in the hollow void.

Advances in electronic and magnetic component design and fabrication have led to electronic circuits having reduced size. Bobbin-wound transformers are often the largest components in an electronic circuit. Bobbin-wound transformers occupy relatively large amounts of space in circuit layouts, as compared to other circuit components, at least in part because the bobbin structure must be accommodated on the circuit board. Also, magnetic components using bobbin-wound windings must include additional structure to accommodate and support the bobbin.

One conventional type of primary winding found in the prior art includes an elongated electrical conductor wound numerous times around a bobbin in overlapping layers. The conventional winding includes a first end initially positioned on a bobbin structure and a second end wound in several layers over the first end. Because the first end extends from an inner loop of the winding nearest the bobbin, a clearance region must exist for the first end to pass from the inner loop to the outer loop for connection to an electrical terminal. Passing the first end from the innermost layer creates requires additional space and material on the magnetic component, increasing size and cost.

In many applications it is desirable to have a transformer including multiple primary windings connected in series and separated by gaps with multiple single-turn secondary windings positioned in the gaps. Prior art transformers having this configuration typically include a bobbin around which the multiple primary windings are wound. The bobbin structure increases the overall size of the transformer.

What is needed, then, is a bobbinless transformer having a primary winding formed without using a bobbin structure to provide shape or support to the winding. Also needed is a low-profile disk-shaped secondary winding for use with the bobbinless primary winding. Additionally, methods of forming the primary and secondary windings are needed.

BRIEF SUMMARY OF THE INVENTION

The present invention provides a transformer apparatus for an electronic circuit. The apparatus includes a base. A bobbinless winding assembly is disposed on the base. The bobbinless winding assembly includes a primary winding with an electrically conductive wire having a plurality of substantially co-planar radially-spiraling turns of the wire. The assembly also includes a secondary winding disposed on the base aligned co-axially with the primary winding. The secondary winding includes a substantially planar annular disk having a radial gap defined therein. The radial gap can be offset from the center axis. The primary and secondary windings have a center axis and define an interior void along the center axis. A core is positioned in the interior void.

The present invention also provides a winding apparatus formed on an elongated wire. The winding apparatus includes a first primary winding including a plurality of radially-spiraling substantially co-planar turns of the wire. The winding apparatus also includes a second primary winding including a second plurality of radially-spiraling substantially co-planar turns of the wire. The first and second primary windings are coaxially aligned. A primary winding gap is defined between the first and second primary windings.

The present invention also provides a single-turn secondary winding apparatus for use in a transformer. The secondary winding apparatus includes a substantially planar annular disk having first and second tabs extending radially therefrom. The disk defines a radial tab gap separating the first and second tabs. The first tab includes a first tab primary bend and first tab secondary bend. The first tab secondary bend is oriented in an angular direction opposite the first tab primary bend.

The present invention also provides a secondary winding apparatus for use in a transformer. The apparatus includes a sheet including an electrically conductive material having first and second substantially planar annular disks connected in series by a bridge member. The bridge member extends substantially radially between the first and second disks. A first prong extends from the first annular disk substantially parallel to the bridge member. A first radial gap is defined between the first prong and the bridge member. A second prong extends from the second annular disk substantially parallel to the bridge member. A second radial gap is defined between the second prong and the bridge member.

The present invention also provides a method of forming a primary winding for an electric circuit. The method includes the steps of providing a coil-former and an electrically conductive wire having first and second free ends. The wire is positioned tangentially transverse to the coil-former at a first longitudinal position on the wire, the first longitudinal position defining a first region between the first free end and the first longitudinal position, the first longitudinal position also defining a second region between the second free end and the first longitudinal position. The first region is wrapped around the coil-former to form a first loop of multiple turns in the wire spiraling radially outward from the coil-former in a first plane. The second region is also wrapped around the coil-former to form a second loop of multiple turns of the wire spiraling radially outward from the coil-former in a second plane substantially parallel to the first plane. The first and second loops are adjacent and the first region extends tangentially from an outer turn on the first loop. The second region extends tangentially from an outer turn on the second loop.

The present invention also provides a method of forming a planar coil apparatus for use in a magnetic device for an electronic circuit. The method includes the step of providing a substantially flat metal sheet having first and second substantially planar annular disks connected by a bridge member extending radially between the first and second disks. The sheet also includes a first prong extending from the first annular disk substantially parallel to the bridge member and defining a first radial gap between the first prong and the bridge member. A second prong extends from the second annular disk substantially parallel to the bridge member and defines a second radial gap between the second prong and the bridge member. The metal sheet is bent at a middle bend along the bridge member at a middle bend angle of substantially 180 degrees. The middle bend defines a third prong extending between the middle bend and the first planar disk. The third prong is bent at a third prong primary bend and is also bent at a third prong secondary bend in the angular direction opposite the third prong primary bend. The second prong is bent at a second prong primary bend and is also bent at a second prong secondary bend in the angular direction opposite the second prong primary bend.

DETAILED DESCRIPTION

Figure 1:
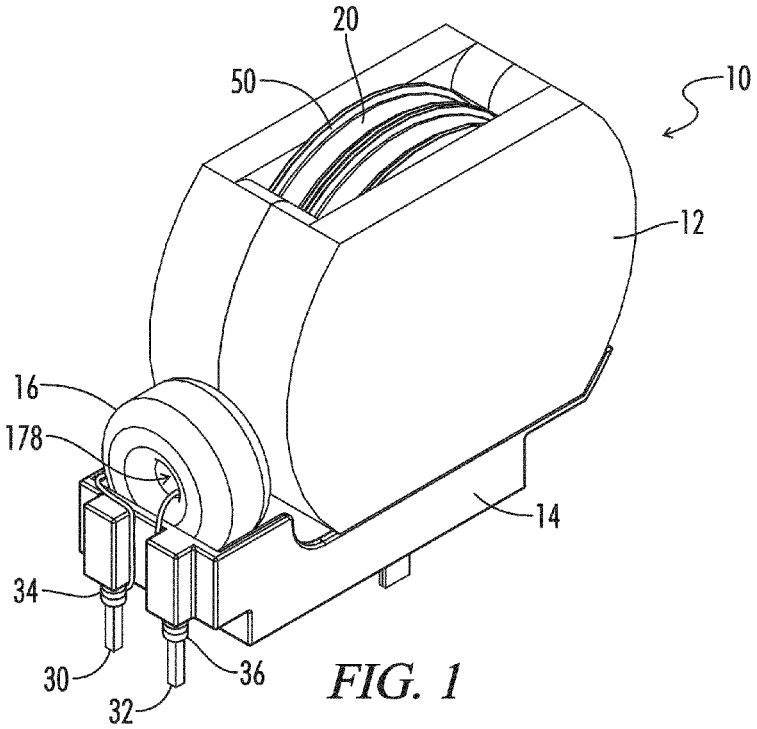
FIG. 1 is a perspective view of one embodiment of a transformer apparatus in accordance with the present invention.

Referring now to FIG. 1, a transformer 10 in accordance with the present invention is generally shown. The transformer 10 includes a base 14 attached to a core 12. The core 12 generally includes a magnetically permeable material, such as a ferrite. In one embodiment, the base 14 includes a first terminal pin 30 and a second terminal pin 32 extending therefrom. A primary winding 20 and a secondary winding 50 are positioned on the base 14. In one embodiment, the primary winding 20 is formed from an elongated conductive wire having a first free end 128 and a second free end 130, seen in FIG. 6A. In one embodiment, the first free end 128 of the primary winding includes a first terminal primary end 34 extending from the base and electrically connected to the first terminal pin 30. The second free end 130 includes a second terminal primary end 36 extending from the base and electrically connected to the second terminal pin 32. In other embodiments, the first and second terminal primary ends 34, 36 can pass internally through the base to connect to the first and second terminal pins 30, 32. In one embodiment, a toroidal current-sense transformer 16 is also positioned on the base, seen in FIG. 1. The current-sense transformer includes a center hole 178 through which one end of the primary winding extends. In the embodiment shown in FIG. 1, the second terminal primary end 36 extends through the center hole 178 in the current-sense transformer 16.

Figure 2:
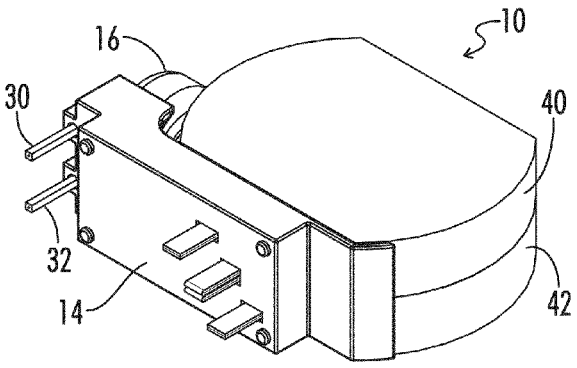
FIG. 2 is a bottom perspective view of the transformer apparatus of FIG. 1.
Figure 3:
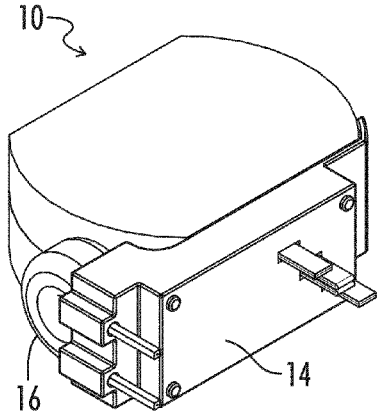
FIG. 3 is a bottom perspective view of the transformer apparatus of FIG. 1.
Figure 4:
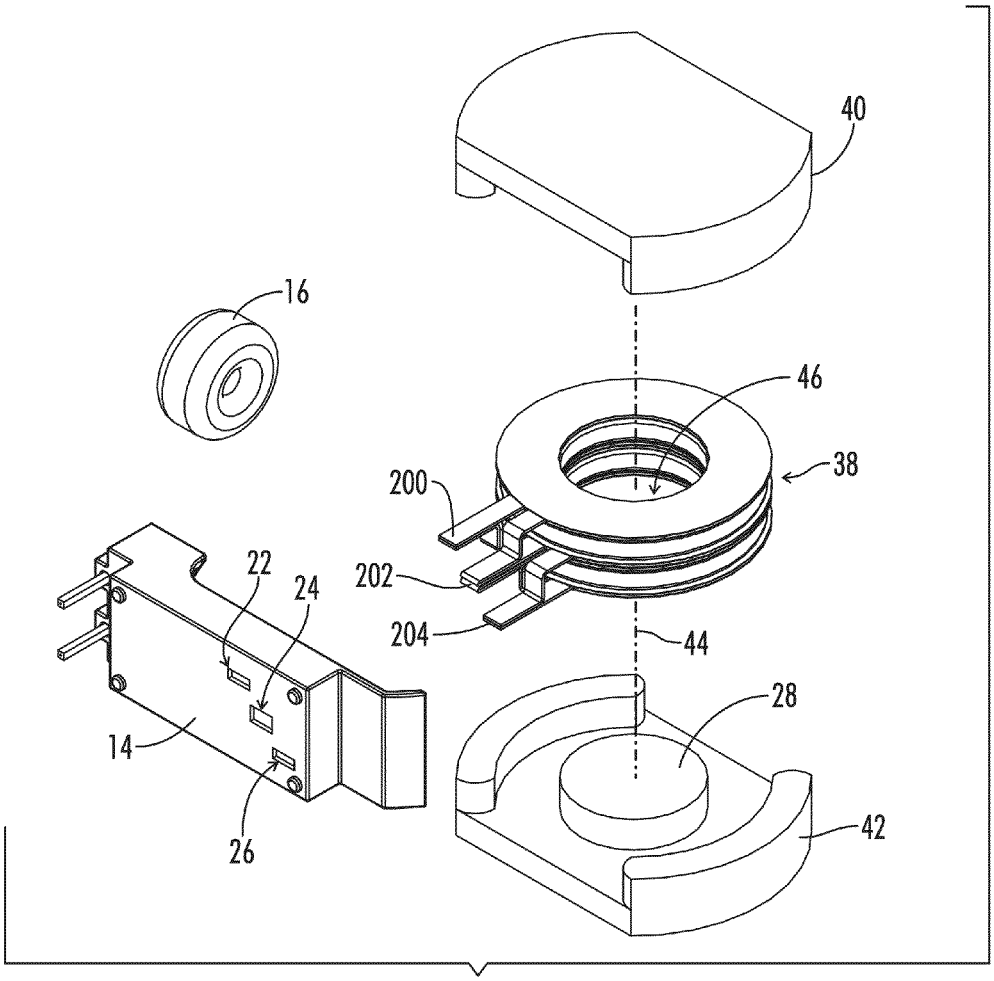
FIG. 4 is a partial exploded view of the transformer apparatus of FIG. 1

As seen in FIGS. 2 and 3, in one embodiment the core 12 includes a first core half 40 and a second core half 42 positioned on the base 14. Referring now to FIG. 4, an exploded view of a transformer 10 in accordance with the present invention is shown. A center axis 44 extends between the first and second core halves 40, 42. In one embodiment, the second core half 42 includes a core post 28 protruding outward from the second core half 42. In another embodiment, not shown, the core post 28 is positioned on the first core half 40. In another embodiment, both the first and second core halves 40, 42 include a core post 28. In one embodiment, the first and second core halves 40, 42 are separated by an air gap. In one embodiment, the air gap is approximately equal to 0.012 mm. In another embodiment, tape having a pre-determined thickness is positioned between the first and second core halves 40, 42. In one embodiment, Mylar type-A tape is used.

A bobbinless winding assembly 38 is positioned between the core halves 40, 42. The bobbinless winding assembly 38 includes the primary winding 20, shown in FIG. 6A, and the secondary winding 50, shown in one embodiment in FIG. 8C. The core post 28 is shaped to fit inside the winding cavity 46. In one embodiment, the core post 28 does not contact the bobbinless winding assembly 38, and an air gap is provided between the core post 28 and the bobbinless winding assembly 38.

Figure 5:
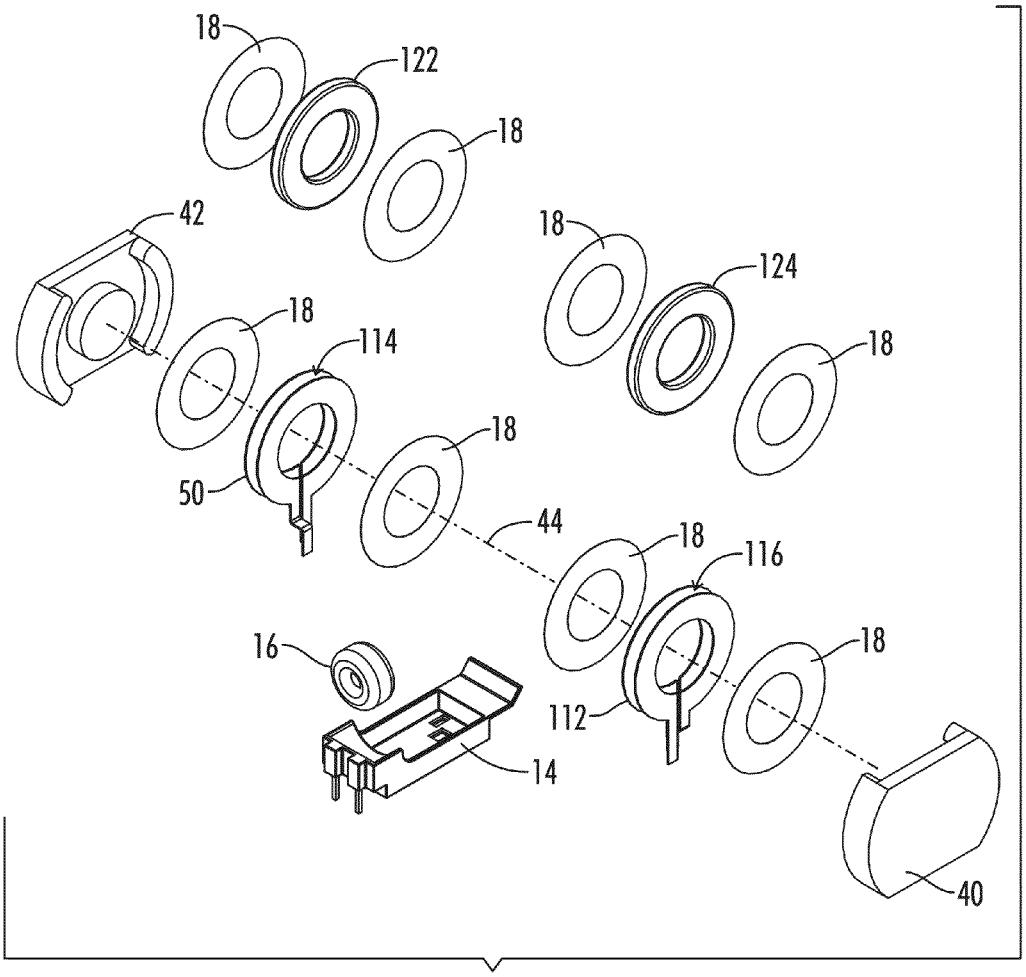
FIG. 5 is an exploded view of one embodiment of a transformer apparatus in accordance with the present invention.

Referring now to FIG. 5, an exploded view of a bobbinless winding assembly in a transformer 10 in accordance with the present invention is shown. The transformer 10 includes first and second primary windings 122, 124 and first and second secondary windings 50, 112. The first and second secondary windings 50, 112 include first and second secondary winding gaps 114, 116, respectively. The first winding gap 114 is shaped to receive the first primary winding 122, and the second winding gap 116 is shaped to receive the second primary winding 124. Upon insertion into the first and second winding gaps 114, 116, the first and second primary windings 122, 124 are aligned substantially co-axially with the first and second secondary windings 50, 112 along the center axis 44. In one embodiment, the first and second primary windings 122, 124 are connected in series to form the primary winding 20.

In the embodiment shown in FIG. 5, a plurality of annular spacers 18 are positioned between each interface separating the first primary winding 122 and first secondary winding 50 when the first primary winding 122 is positioned in the first winding gap 114. Similarly, a plurality of annular spacers 18 are positioned between each interface separating the second primary winding 124 and the second secondary winding 112 when the second primary winding 124 is positioned in the second winding gap 116. Additional spacers 18 are positioned between the first secondary windings 50 and the second core half 42 and between the second secondary winding 112 and the first core half 40.

Figure 6A:
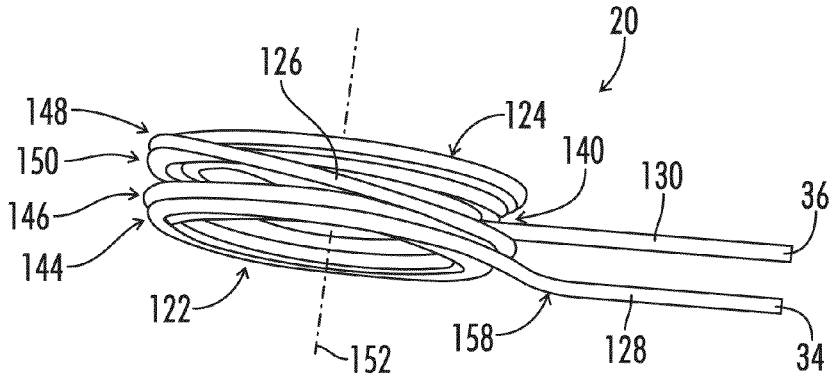
FIG. 6A is a perspective view of a primary winding apparatus in accordance with the present invention.

Referring now to FIG. 6A, a primary winding apparatus 20 in accordance with the present invention is generally shown. The primary winding apparatus 20 includes a first primary winding 122 and a second primary winding 124 formed from an elongated wire. The primary winding apparatus 20 is bobbinless. The term bobbinless, as used herein, refers to a winding having an annular shape without having a bobbin structure positioned in the winding cavity to provide support or shape for the winding. The bobbinless winding of the present invention retains its annular shape without the use of a bobbin. The first primary winding 122 includes first and second loops 144, 146, and the second primary winding 124 includes third and fourth loops 148, 150, shown in FIGS. 6A and 6B. Each loop 144, 146, 148, 150 includes multiple turns of the wire around a primary winding axis 152.

The first and second loops 144, 146 each include a plurality of radially-spiraling turns of the wire. The first loop 144 begins at a first free end 128 and spirals radially inward toward the primary winding axis 152. The turns forming the first loop 144 are oriented substantially in a first plane. At the innermost turn on the first loop 144, the wire passes axially out of the first plane and spirals radially outward a number of turns to form the second loop 146. The turns of the second loop 146 are oriented in a second plane substantially parallel to the first plane. The outer turn of the second loop 146 includes a middle section 126 of the wire extending axially out of the second plane across a primary winding gap 140. The middle section 126 then spirals radially inward toward the primary winding axis 152 to form the third loop 148. The third loop 148 includes a number of turns of the wire oriented in a third plane oriented substantially parallel to the first and second planes. At the innermost turn of the third loop 148, the wire extends axially out of the third plane toward the first primary winding and spirals radially outward, forming the fourth loop 150 between the third loop 148 and the second loop 146. The fourth loop 150 is oriented in a fourth plane oriented substantially parallel to the third plane. In an alternative embodiment not shown, the fourth loop 150 can be formed on the side of the third loop 148 opposite the winding gap 140.

The first and second loops 144, 146 of the first primary winding 122 include the first free end 128 and the middle section 126 extending tangentially from an outer turn on each respective loop. The outer positioning of the first free end 128 and the middle section 126 allows a reduced overall component size because the wire does not require space to pass from an inner turn to the exterior of the winding for a terminal connection. Similarly, the third and fourth loops 148, 150 of the second primary winding 124 include the middle section 126 and the second free end 130 extending tangentially from an outer turn on each respective loop, also preventing the need to provide clearance space on the transformer to pass an end of the wire from an inner turn to the exterior. In one embodiment, shown in FIG. 6C, the first free end 128 includes a first free end bend 158 for positioning the first free end 128 parallel to the second free end 130.

The first and second primary windings 122, 124 are connected in series by the middle section 126. The first primary winding 122 includes a total number of turns M, including the number of turns in the first and second loops 144, 146 combined. The second primary winding 124 includes a total number of turns N, including the number of turns in the third and fourth loops 148, 150 combined. In one embodiment, M and N are both between 3.0 and 12.0. In another embodiment M and N both equal 7.5. In another embodiment, either M or N is equal to 7.0.

In one embodiment, a dielectric spacer (similar to spacer 18 shown in FIG. 5) may be positioned between the first and second, and third and fourth, loops to prevent electrical contact between loops in the axial direction. In another embodiment, the wire forming the first and second primary windings 122, 124 is coated with an enamel to insulate the wire. In other embodiments, the wire may be surrounded with other types of electrical insulation, including but not limited to an insulative sheath or an epoxy coating. In yet another embodiment, the first and second primary windings 122, 124 are held in position without a bobbin structure by use of glue coated on each winding. In different embodiments, the glue can be polymerized by heat or specific wavelengths of light. In one embodiment, the glue is polymerized by induction heating.

Figure 6B:
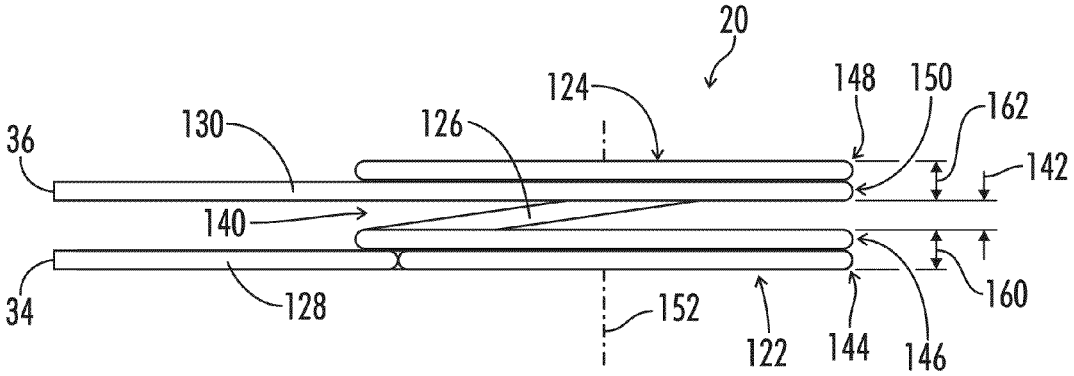
FIG. 6B is a perspective view of the primary winding apparatus of FIG. 6A.

FIG. 6B shows a primary winding apparatus 20 having a first primary winding 122 and a second primary winding 124 formed on a single wire. In other embodiments, additional primary windings can be formed on the same wire. For example, third and fourth primary windings, not shown, could be formed co-axially on the same wire as the first and second primary windings. Each additional winding formed on the same primary winding 20 may include a gap for providing an interleaved winding configuration when single-turn secondary windings are inserted in the gaps.

Referring to FIG. 6B, the first primary winding 122 includes a first primary winding width 160, and the second primary winding 124 includes a second primary winding width 162. In one embodiment, the first and second primary winding widths 160, 162 are each equal to 2*R, where R equals the radius of the wire forming the primary winding apparatus 20. The first and second primary windings 122, 124 are also separated by a primary winding gap 140 positioned between the second and fourth loops 146, 150 defining a primary winding gap distance 142. In one embodiment, the primary winding gap distance 142 is substantially uniform between the second loop 146 and the fourth loop 150.

The first free end 128 includes a first terminal primary end 34. The second free end 130 includes a second terminal primary end 36. Each terminal primary end 34, 36 is configured for connection to an electric circuit. Referring to FIG. 1, in one embodiment the second terminal primary end 36 passes through a toroidal current-sense transformer 16 positioned on the base 14. In another embodiment, not shown, the first terminal primary end 34 passes through the toroidal current sense transformer 16. The first and second terminal primary ends 34, 36 connect to first and second terminal pins 30, 32, respectively positioned on the base 14. In an alternate embodiment not shown, each first and second terminal primary end 34, 36 connect directly to an electric circuit.

Figure 7A:
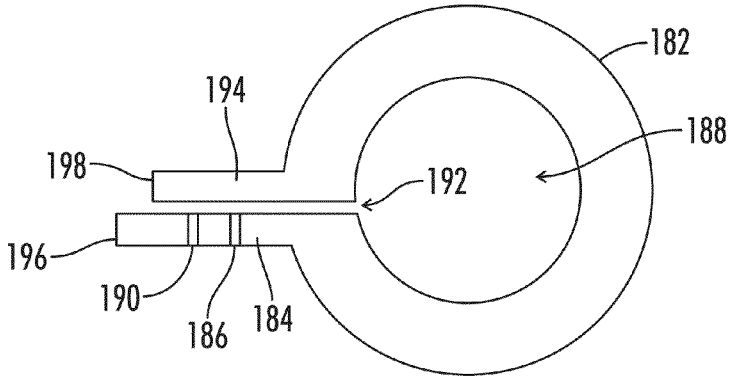
FIG. 7A is a plan view of a single-turn secondary winding apparatus in accordance with the present invention.
Figure 7B:
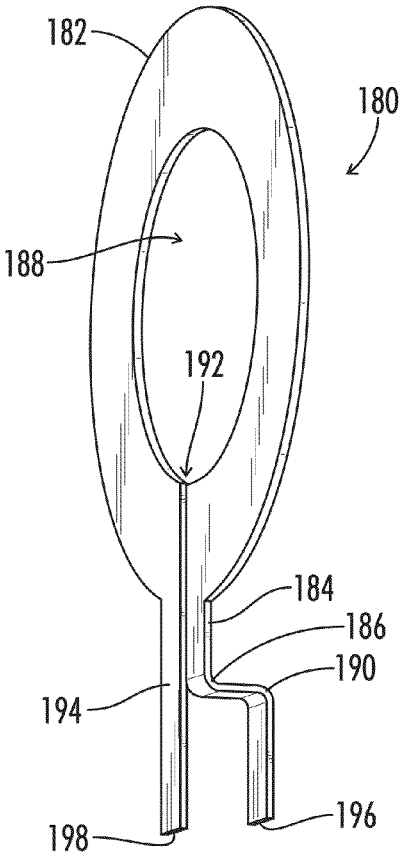
FIG. 7B is a perspective view of a single-turn secondary winding apparatus in accordance with the present invention.
Figure 7C:
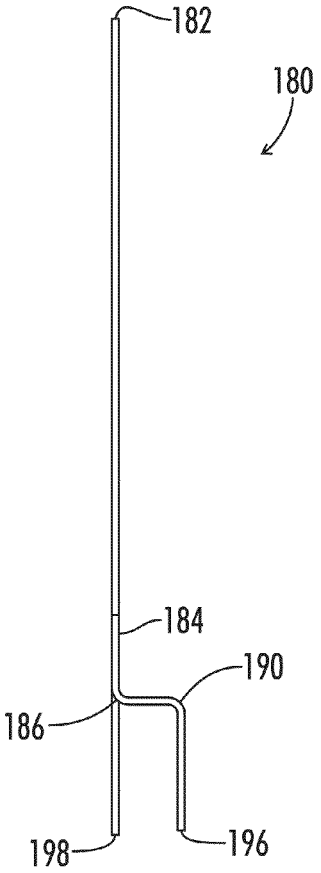
FIG. 7C is an elevation view of a single-turn secondary winding apparatus in accordance with the present invention.

Referring now to FIGS. 7A-7C, one embodiment of a single-turn secondary winding 180 in accordance with the present invention is shown. The single-turn secondary winding 180 includes a substantially planar annular disk 182 defining an interior disk void 188. The single-turn secondary winding 180 includes first and second tabs 184, 194 extending substantially radially from the disk 182. The first and second tabs 184, 194 are separated by a substantially radial tab gap 192. The first tab 184 includes a first tab primary bend 186 and a first tab secondary bend 190. In one embodiment, the first tab primary bend 186 is a right angle, and the first tab secondary bend 190 is a right angle oriented in the angular direction opposite the first tab primary bend 186, as seen in FIG. 7B. In other embodiments not shown, the first tab primary and secondary bends 186, 190 can be oriented in acute or obtuse angles relative to the first tab 184. A first tab terminal 196 is positioned on the distal end of the first tab 184, and a second tab terminal 198 is positioned on the distal end of the second tab 194. Each tab terminal 196, 198 is configured for connection to an electric circuit. In one embodiment, each tab terminal 196, 198 extends through a clearance hole in the base 14. Multiple single-turn secondary windings 180 can be connected in series or in parallel by connecting the first and second tab terminals 196, 198 of separate single-turn secondary windings in accordance with the invention. In one configuration, multiple single-turn windings are connected in series facing in the same axial direction. In another configuration, multiple single-turn windings are connected in parallel facing in opposite axial directions.

Referring now to FIGS. 8A-8E, a secondary winding apparatus 50 in accordance with the present invention is shown. In one embodiment, the secondary winding apparatus 50 is formed from a substantially planar sheet 48 of electrically conductive material, shown in FIG. 8A. In one embodiment, the sheet 48 includes a copper foil stamped to form the general shape shown in FIG. 8A. In other embodiments, the general shape of the sheet 48 shown in FIG. 8A can be formed by other material forming techniques, including pressing, printing, cutting, etching, lithographing or milling.

Figure 8A:
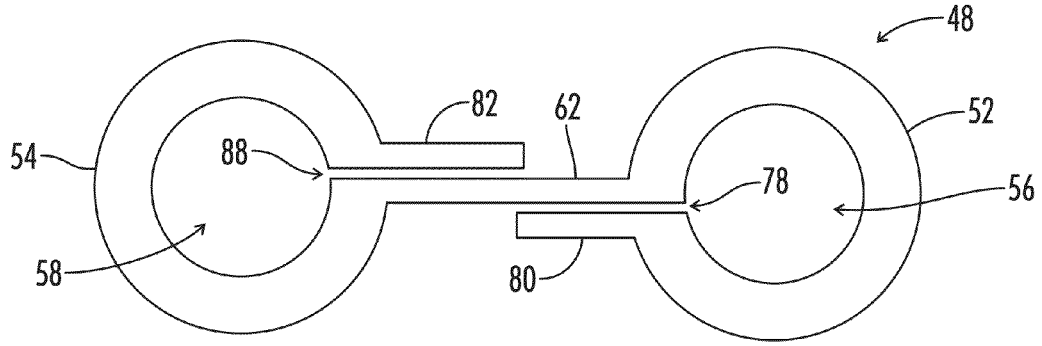
FIG. 8A is a plan view of a secondary winding apparatus in accordance with the present invention.

The sheet 48 includes a first annular disk 52 defining a first disk void 56. The first annular disk 52 has a substantially planar shape. A second annular disk 54 is formed on the same sheet 48 defining a second disk void 58. The first annular disk 52 defines a first disk gap 78 extending generally radially across the first disk 52. The second disk 54 defines a second disk gap 88 extending generally radially across the second disk 54. The first disk 52 includes a first prong 80 extending generally radially from the first disk 52 adjacent the first disk gap 78. A bridge member 62 extends generally radially between the first and second disks 52, 54 connecting the first and second disks 52, 54. The bridge member 62 provides a series connection between the first and second disks 52, 54. The second disk 54 includes a second prong 82 extending generally radially from the second disk 54. The second disk gap 88 extends between the second prong 82 and the bridge member 62. In one embodiment, the first and second prongs, 80, 82 are positioned on opposing sides of the bridge member 62, as seen in FIG. 8A. In other embodiments not shown, the first and second bridge members 80, 82 can be positioned on the same side of the bridge member 62.

Figure 8B:
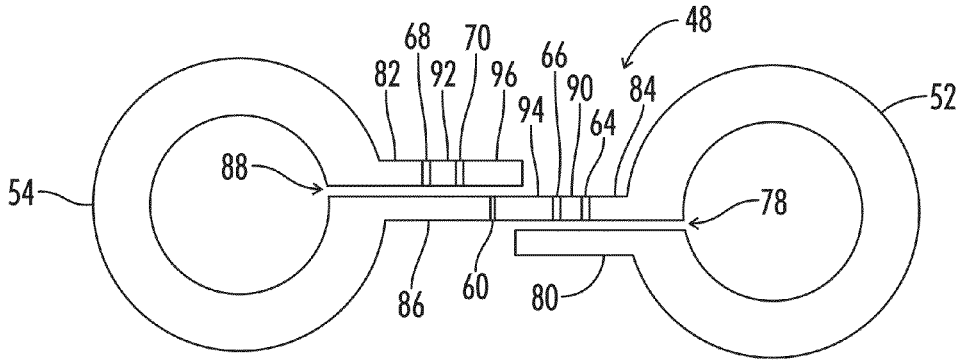
FIG. 8B is a plan view of a secondary winding apparatus in accordance with the present invention.
Figure 8C:
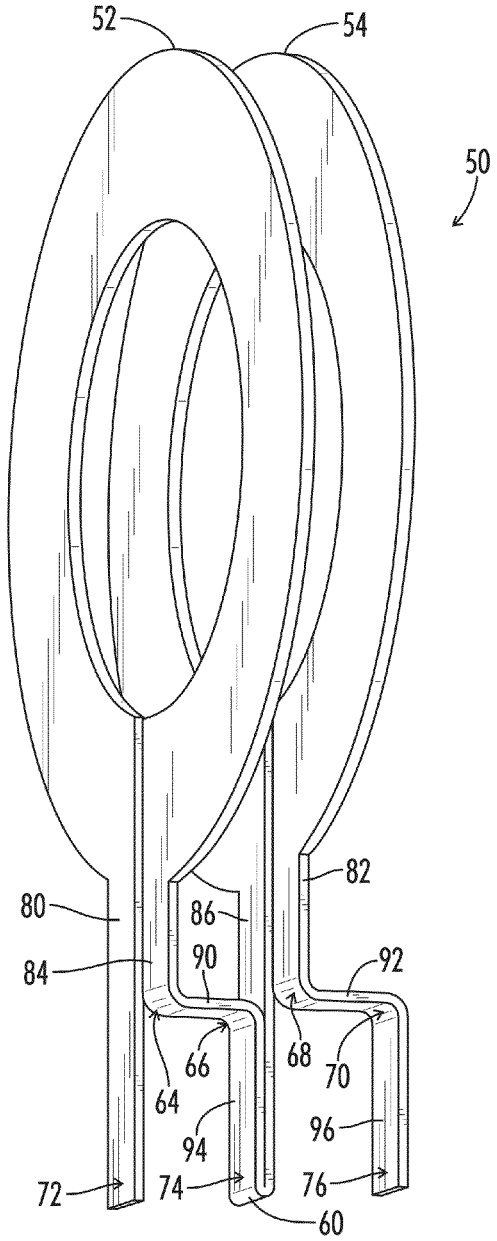
FIG. 8C is a perspective view of a secondary winding apparatus in accordance with the present invention.
Figure 8D:
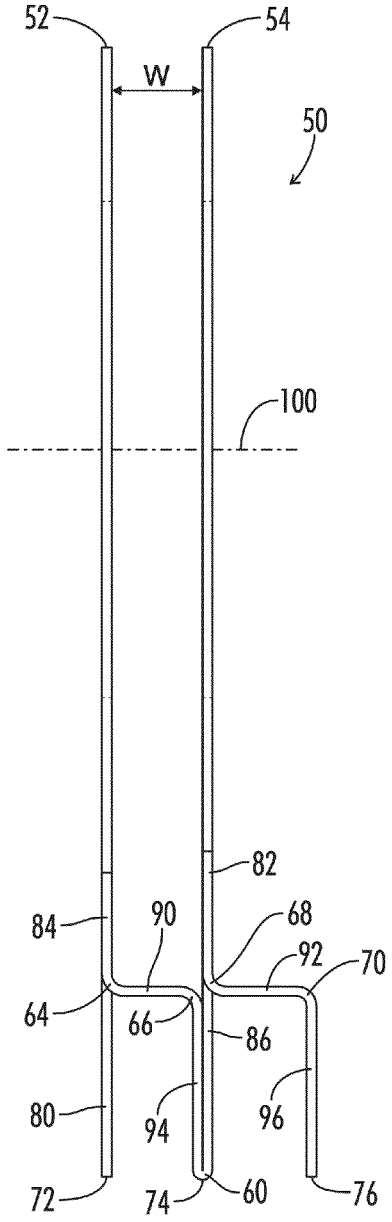
FIG. 8D is an elevation view of the secondary winding apparatus of FIG. 8C.

The secondary winding apparatus 50, shown in FIG. 8C, is formed by bending the sheet 48, previously shown in FIG. 8A. Upon bending the sheet 48, the first and second annular disks 52, 54 form single-turn conductive windings electrically connected to each other in series. The sheet 48, shown in FIG. 8A, is bent at multiple bending locations, shown in FIGS. 8B-8E. The bridge member 62 is bent at a middle bend 60 between the first and second disks 52, 54. The section of the bridge member 62 between the middle bend 60 and the first disk 52 defines the third prong 84, and the section of the bridge member 62 between the middle bend 60 and the second disk 54 defines the fourth prong 86, shown in FIGS. 8B and 8C. The third prong 84 is further bent at a third prong primary bend 64 and at a third prong secondary bend 66, separated by a first lateral section 90. A first flange 94 extends between the third prong secondary bend 66 and the middle bend 60. In one embodiment, the first disk 52 is oriented in a first disk plane, and the first flange 94 is oriented in an offset first flange plane parallel to the first disk plane. In other embodiments, the first flange 94 and the first disk 52 are oriented in non-parallel planes. The first flange 94 and the fourth prong 86 together form a second terminal end 74 adapted for connection to an electric circuit. The second terminal end 74 can be used for connecting the secondary winding 50 to an electric circuit in a center tap configuration.

Referring further to FIGS. 8A-8E, the second prong 82 includes a second prong primary bend 68 and a second prong secondary bend 70. A second lateral section 92 is defined between the second prong primary bend 68 and the second prong secondary bend 70, shown in FIG. 8C. In one embodiment, the first and second lateral sections 90, 92 are not equal in length. In other embodiments, the first and second lateral sections 90, 92 are equal in length. A second flange 96 extends between the second prong secondary bend 70 and the third terminal end 76. In one embodiment, the second disk 54 is oriented in a second disk plane, and the second flange 96 is oriented in an offset second flange plane substantially parallel to the second disk plane, seen in FIGS. 8C-8E. In other embodiments not shown, the second flange 96 is oriented in a non-parallel plane relative to the second disk plane. The first prong 80 includes a first terminal end 72 configured for connection to an electric circuit.

Figure 8E:
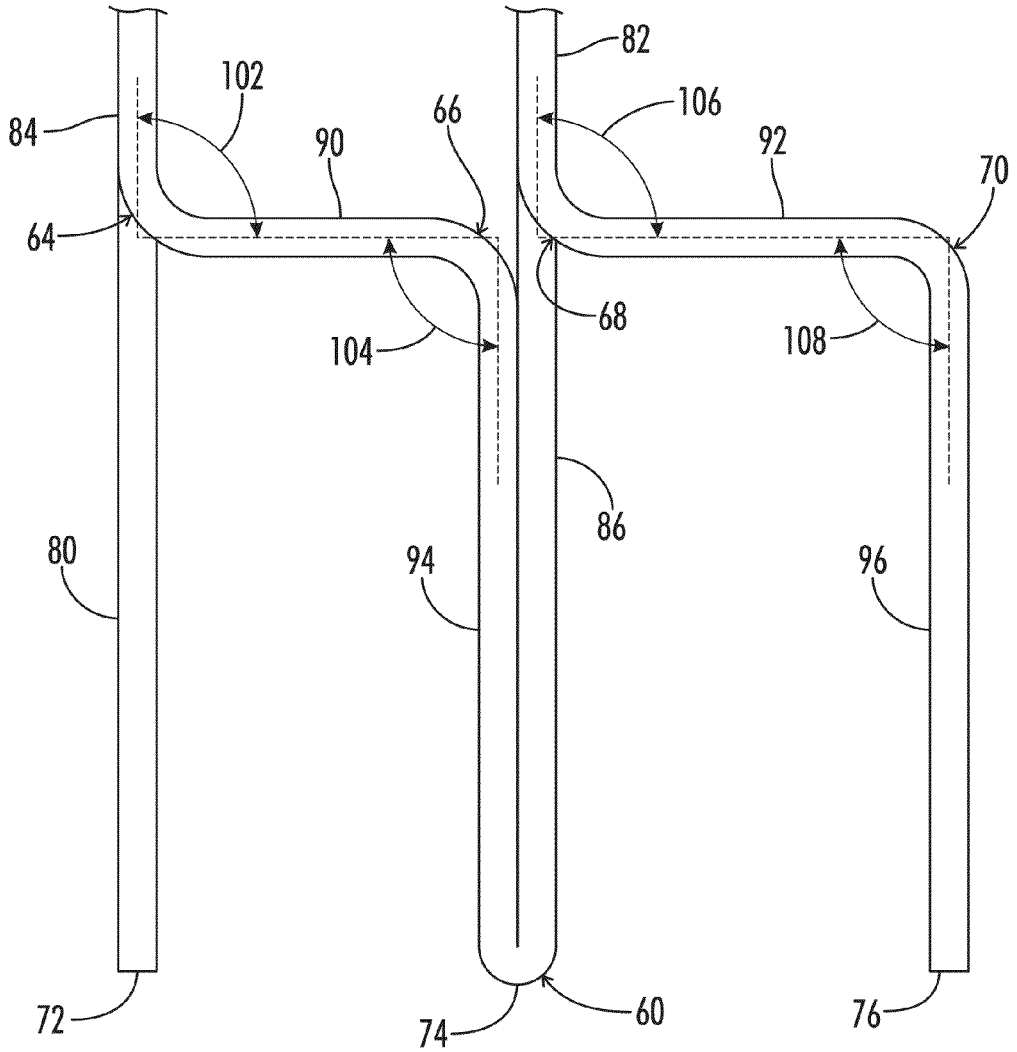
FIG. 8E is a detail view of the secondary winding apparatus of FIG. 8D.

Referring to FIG. 8E, a detail view of the terminal region of one embodiment of a secondary winding apparatus in accordance with the present invention is shown. The middle bend 60 is oriented at a middle bend angle equal to 180 degrees. In one embodiment, the third prong primary bend 64 is oriented at a third prong primary bend angle 102 substantially equal to ninety degrees, and the third prong secondary bend 66 is oriented at a third prong secondary bend angle 104 substantially equal to ninety degrees in an angular direction opposite the first prong primary bend angle 102. In other embodiments, the third prong primary and secondary bend angles 102, 104 can be greater than or less than ninety degrees, causing the first lateral section 90 to be oriented at a non-perpendicular angle relative to the third prong 84 and the first flange 94. Similarly, in one embodiment, the second prong primary bend 68 is oriented at a second prong primary bend angle 106 substantially equal to 90 degrees, and the second prong secondary bend 70 is oriented at a second prong secondary bend angle 108 substantially equal to ninety degrees in the opposite angular direction of the second prong primary bend angle 106. The second lateral member 92 is thus oriented substantially perpendicular to the second prong 82 and the second flange 96 in one embodiment. In other embodiments in accordance with the present invention, the second prong primary and secondary bend angles 106, 108 can be oriented at acute or obtuse angles relative to the second prong 82 and the second flange 96, causing the second lateral member 92 to be oriented at a non-perpendicular angle relative to the second prong 82 and the second flange 96.

Figure 9A:
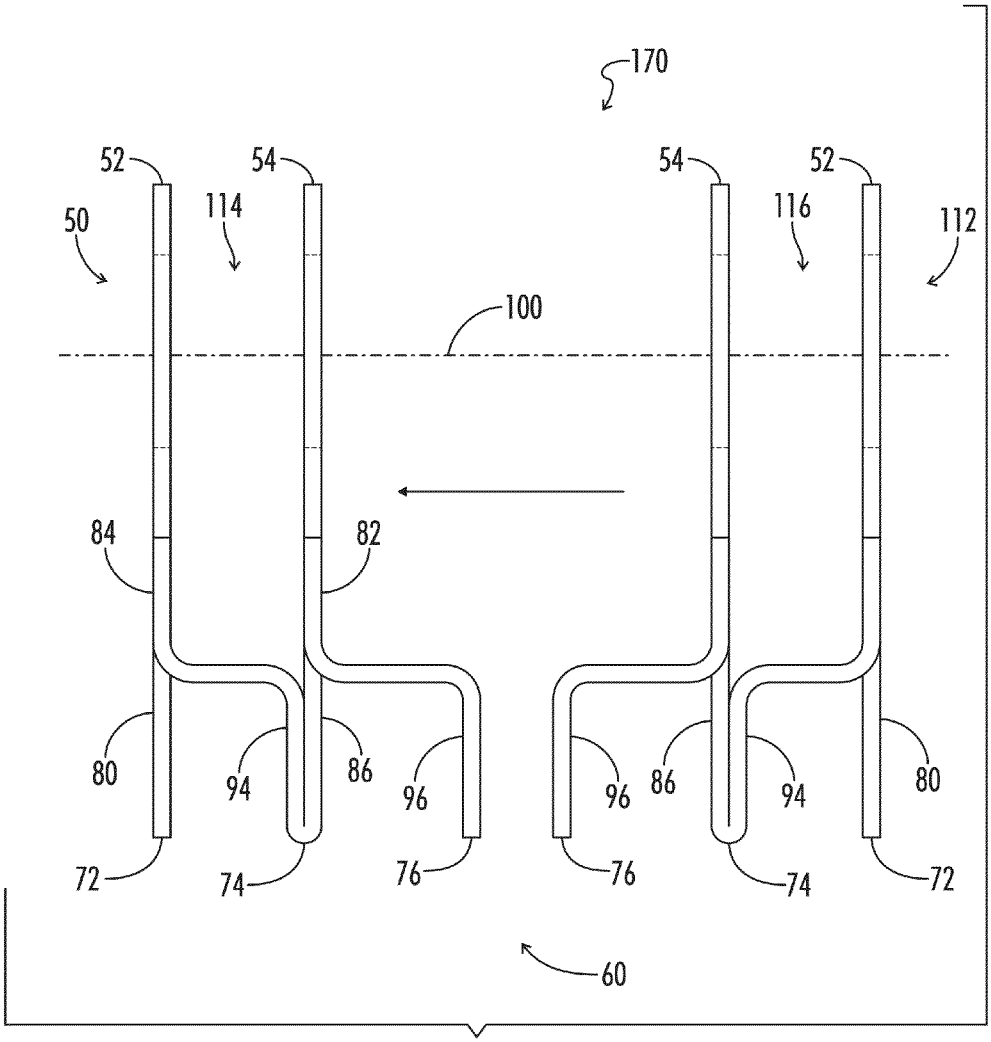
FIG. 9A is an exploded view of a secondary winding assembly in accordance with the present invention.
Figure 9B:
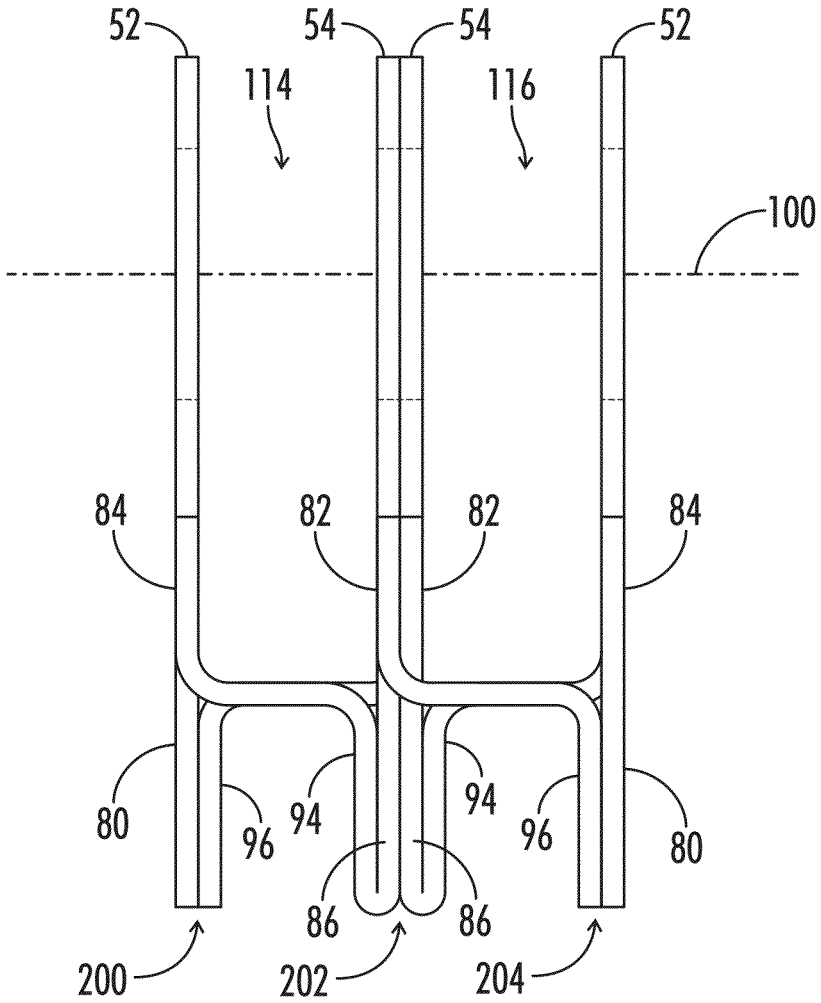
FIG. 9B is an elevation view of a secondary winding assembly in accordance with the present invention.

Referring now to FIG. 9A, a secondary coil assembly 170 in accordance with the present invention is formed by positioning two secondary windings 50, 112 of the type depicted in FIG. 8C opposite each other. As seen in FIGS. 9A and 9B, a first secondary winding 50 is positioned to face a second secondary winding 112 oriented so that the second planar disk 54 of the first secondary winding 50 faces the second planar disk 54 of the second secondary winding 112, as seen in FIG. 9A. The first terminal end 72 of the first secondary winding 50 and the third terminal end 76 of the second secondary winding 112 form a first terminal post 200, as seen in FIG. 9B. The second terminal ends 74, 74 of the first and second secondary windings 50, 112 together form a second terminal post 202, seen in FIG. 9B. The third terminal end 76 of the first secondary winding 50 and the first terminal end 72 of the second secondary winding 112 form a third terminal post 204, also seen in FIG. 9B. The first, second and third terminal posts, 200, 202, 204 each extend through first, second and third terminal clearance holes 22, 24, 26, respectively, located in the base 14, as seen in FIG. 4. In one embodiment, the second terminal post 202 is configured for wiring the secondary winding assembly 170 in a center tap configuration.

Also shown in FIG. 9B, the secondary winding assembly 170 includes first and second secondary winding gaps 114, 116. The first and second secondary winding gaps 114, 116 are shaped for receiving the first primary winding 122 or the second primary winding 124 of the primary winding apparatus 20, wherein the second coil axis 100 is aligned with the primary winding axis 152. When the first and second primary windings 122, 124 are positioned in the first and second secondary winding gaps 114, 116 respectively, a bobbinless winding assembly 38, is formed. In the bobbinless winding assembly 38, the primary winding axis 152, the secondary winding axis 100 and the center axis 44 are all aligned.

Figure 10A:
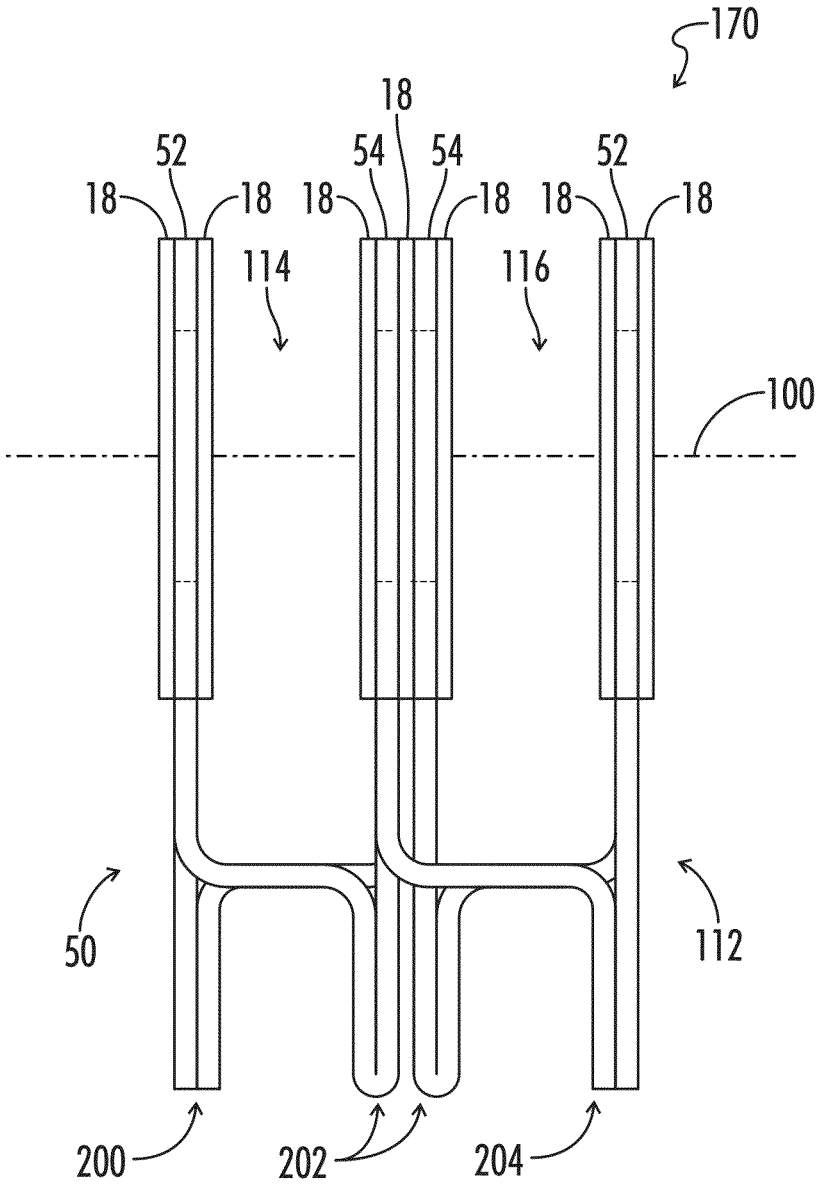
FIG. 10A is an elevation view of a secondary winding assembly in accordance with the present invention.
Figure 10B:
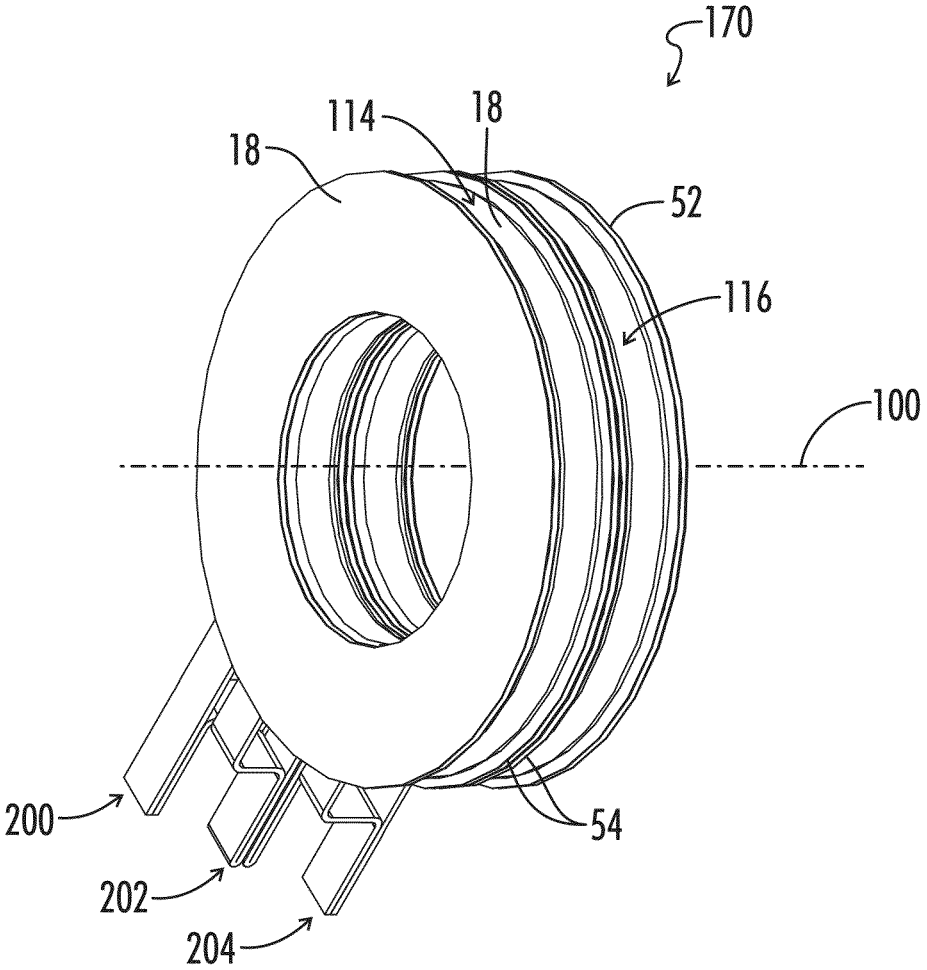
FIG. 10B is a perspective view of a secondary winding assembly in accordance with the present invention.
Figure 11:
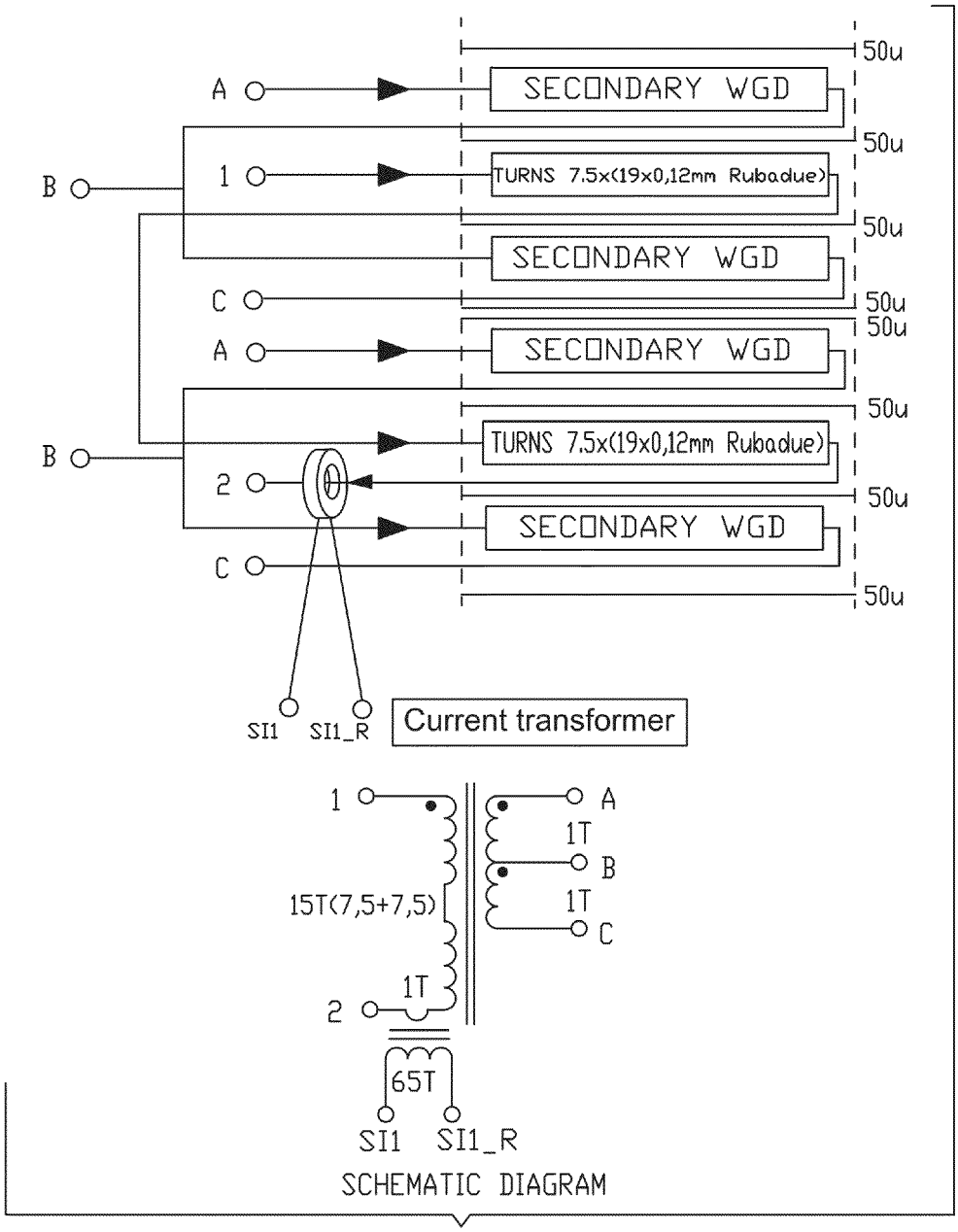
FIG. 11 is a wiring diagram of a transformer apparatus in accordance with the present invention.

Referring now to FIG. 10A, one embodiment of a secondary winding assembly 170, includes a plurality of spacers 18 positioned on each side of each disk 52, 54 on both the first and second secondary windings 50, 112. Each spacer 18 includes an uninterrupted annular ring positioned concentrically with each disk 52, 54 along the secondary coil axis 100. The secondary winding assembly 170 includes a first secondary winding gap 114 and a second secondary winding gap 116, seen in FIG. 10B. The first and second primary windings 50, 112 of the primary winding apparatus 20 can be positioned in the first and second secondary winding gaps 114, 116. Referring to FIG. 11, a wiring diagram showing one embodiment of a circuit for a transformer in accordance with the present invention is shown.

Referring now to FIGS. 12A-12G, exemplary steps of one embodiment of a method of forming a primary winding in accordance with the present invention are shown. The method includes the step of providing a coil-former 210 and an electrically conductive wire 212 having first and second free ends 218, 220, shown in FIG. 12A. The wire 212 is positioned tangentially transverse to the coil former 210 at a first longitudinal position 214. The first longitudinal position 214 defines a first region 216 between the first longitudinal position 214 and the first free end 218 and a second region 222 between the first longitudinal position 214 and the second free end 220.

Figure 12A:
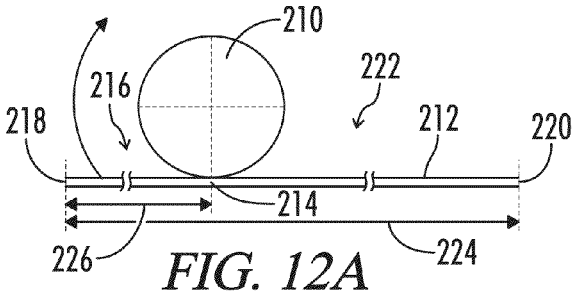
FIG. 12A is an exemplary side view of one step of a method for forming a primary winding apparatus in accordance with the present invention.
Figure 12B:
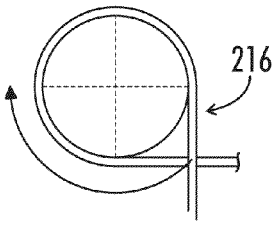
FIG. 12B is an exemplary side view of one step of a method for forming a primary winding apparatus in accordance with the present invention.
Figure 12C:
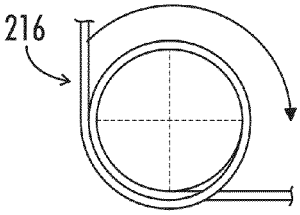
FIG. 12C is an exemplary side view of one step of a method for forming a primary winding apparatus in accordance with the present invention.
Figure 12D:
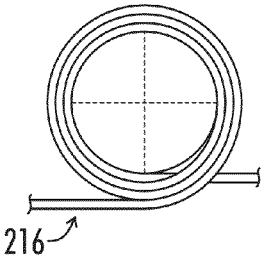
FIG. 12D is an exemplary side view of one step of a method for forming a primary winding apparatus in accordance with the present invention.

The first region 216 is wrapped around the coil-former 210 to form a first loop of multiple turns in the wire spiraling radially outward from the coil-former 210 in a first plane, as seen in FIGS. 12B-12D.

Figure 6C:
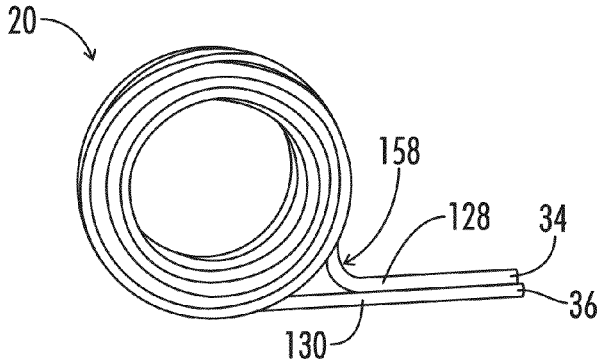
FIG. 6C is a side perspective view of the primary winding apparatus of FIG. 6A.
Figure 12E:
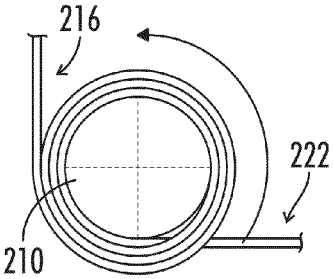
FIG. 12E is an exemplary side view of one step of a method for forming a primary winding apparatus in accordance with the present invention.
Figure 12F:
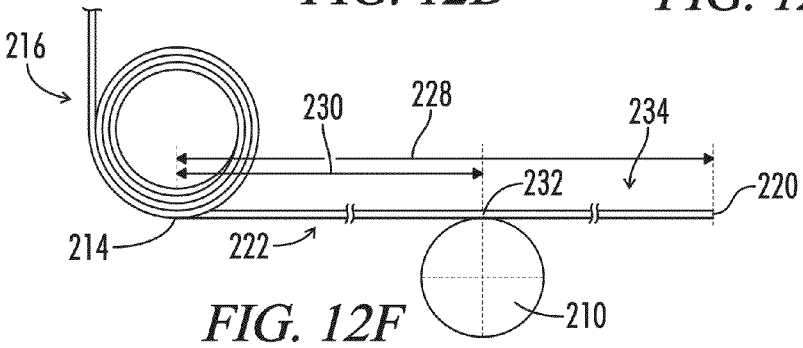
FIG. 12F is an exemplary side view of one step of a method for forming a primary winding apparatus in accordance with the present invention.
Figure 12G:
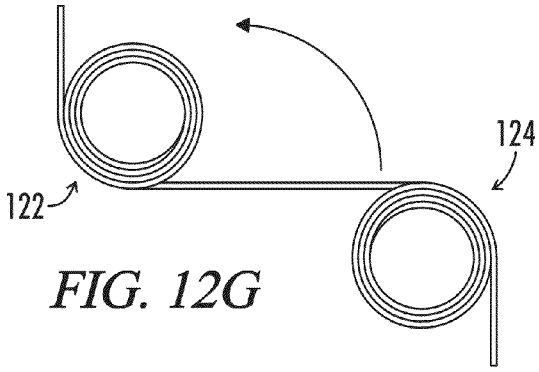
FIG. 12G is an exemplary side view of one step of a method for forming a primary winding apparatus in accordance with the present invention.

Referring to FIG. 12E, the second region 222 is wrapped around the coil-former 210 to form a second loop of multiple turns in the wire spiraling radially outward from the coil-former 210 in a second plane substantially parallel to the first plane. In one embodiment, the first and second loops are adjacent. The first region 216 extends tangentially from an outer turn of the first loop and the second region 222 extends tangentially from an outer turn of the second loop, as seen in FIG. 12F. Referring further to FIG. 12F, additional steps of forming the primary winding include positioning the coil-former tangentially transverse to the wire at a second longitudinal position 232 on the wire between the first longitudinal position 214 and the second free end 220, wherein the second longitudinal position defines a third region 234 between the second longitudinal position 232 and the second free end 220. The third region 234 is wrapped around the coil-former 210 to form a third loop of multiple turns in the wire spiraling radially outward from the coil-former in a third plane. In one embodiment, the third plane is substantially parallel to the second plane. The second region is wrapped around the coil-former to form a fourth loop of multiple turns in the wire spiraling radially outward from the coil former in a fourth plane substantially parallel to the third plane, thereby forming the second primary winding 122, shown in FIG. 12G. In one embodiment, the third and fourth loops are adjacent. The second primary winding 124 is then bent along the wire toward the first primary winding 122 to form a primary winding 20, as seen in FIG. 6C.

Referring to FIG. 12A, in one embodiment, the wire 212 has a total length, L, 224, and the first longitudinal position 214 is located at a distance, A, 226 equal to 0.25*L from the first free end 218. Referring to FIG. 12F, in one embodiment, the first primary winding defines a length, Y, 228 of the wire from the first longitudinal position 214 to the second free end 220. The second longitudinal position 232 is located at a distance, B, 230 substantially equal to 0.5*Y from the first longitudinal position 214 toward the second free end 220.

The present invention further provides a method of forming a planar coil apparatus for use in a magnetic device for an electronic circuit. The method includes a step of providing a substantially flat metal sheet having first and second substantially planar annular disks connected by a bridge member extending radially therebetween. The sheet includes a first prong extending from the first annular disk substantially parallel to the bridge member and defining a first radial gap between the first prong and the bridge member. The sheet also includes a second prong extending from the second annular disk substantially parallel to the bridge member and defining a second radial gap between the second prong and the bridge member, as seen in FIGS. 8A and 8B. The method also includes the step of bending the metal sheet at a middle bend location along the bridge member at a middle bend angle of substantially 180 degrees, thereby defining a third prong extending between the middle bend location and first planar loop. The third prong is bent at a third prong primary bend and also bent at a third prong secondary bend in the opposite angular direction of the third prong primary bend. The second prong is bent at a second prong primary bend and at a second planar loop secondary bend in the opposite angular direction of the second prong primary bend.

Thus, although there have been described particular embodiments of the present invention of a new and useful Magnetic Component with Bobbinless Winding, it is not intended that such references be construed as limitations upon the scope of this invention except as set forth in the following claims.

What is claimed is:

1. A transformer apparatus comprising:

a base;

a bobbinless winding assembly disposed on the base, the assembly comprising:

a primary winding including an electrically conductive wire having a plurality of substantially co-planar radially-spiraling turns of the wire;

a secondary winding aligned co-axially with the primary winding, the secondary winding including a substantially planar disk having a radial gap defined therein, the primary and secondary windings having a center axis defining an interior void along the center axis;

a core positioned in the interior void, the base positioned on the exterior of winding assembly;

a toroidal current-sense transformer positioned on the base, the current-sense transformer defining a center hole therein; and the primary winding including a free end passing through the center hole.

2. The apparatus of claim 1, further comprising:

a first terminal pin protruding from the base;

a second terminal pin protruding from the base;

wherein each terminal pin is electrically connected to the primary winding.

3. The apparatus of claim 1, wherein:

the primary winding further comprises first and second primary windings co-axially aligned and electrically connected in series; and wherein the first and second primary windings are separated by a primary winding gap.

4. The apparatus of claim 3, wherein the annular disk of the secondary winding is positioned in the primary winding gap aligned co-axially with the first and second primary windings.

* * * * *